United States Patent [19]

Ueno

[11] Patent Number: 4,586,539

[45] Date of Patent: May 6, 1986

[54] FLOW ADJUSTING VALVE AND DIE CASTING MACHINE INCORPORATING THE SAME

[75] Inventor: Toyoaki Ueno, Yoshiki, Japan

[73] Assignee: UBE Industries, Ltd., Japan

[21] Appl. No.: 455,512

[22] Filed: Jan. 4, 1983

[30] Foreign Application Priority Data

| | | | |
|---|---|---|---|
| Jan. 5, 1982 | [JP] | Japan | 57-000022[U] |
| Nov. 16, 1982 | [JP] | Japan | 57-199708 |
| Nov. 16, 1982 | [JP] | Japan | 57-199709 |

[51] Int. Cl.[4] ..... F16K 31/04; F16K 3/26

[52] U.S. Cl. ..... 137/625.38; 251/282; 251/129.12

[58] Field of Search ..... 251/133, 134, 282; 137/625.35, 625.38, 625.12

[56] References Cited

U.S. PATENT DOCUMENTS

| | | | |
|---|---|---|---|
| 803,000 | 10/1905 | Lentz | 137/625.35 |
| 2,672,158 | 3/1954 | Cormany | 251/282 |
| 3,137,475 | 6/1964 | Schoenecker | 251/133 X |
| 3,258,985 | 7/1966 | Jordan | 251/134 X |
| 3,476,359 | 11/1969 | Newell | 251/282 X |
| 4,274,433 | 6/1981 | Schnall | 251/282 X |
| 4,437,388 | 3/1984 | Budzich | 251/133 X |

FOREIGN PATENT DOCUMENTS

| | | | |
|---|---|---|---|
| 1197221 | 7/1965 | Fed. Rep. of Germany . | |
| 2141519 | 2/1973 | Fed. Rep. of Germany | 251/133 |
| 295994 | 2/1929 | United Kingdom | 137/625.35 |
| 411370 | 6/1934 | United Kingdom | 251/133 |

OTHER PUBLICATIONS

Beispiele der Praktischen Bedeutung des Einsatzes Geregelter Spritzgismachinen.

Automatische Steuerung an Hydraulischen Pressen and Spritzgussmachinen.

*Primary Examiner*—Arnold Rosenthal

*Attorney, Agent, or Firm*—Finnegan, Henderson, Farabow, Garrett & Dunner

[57] ABSTRACT

A flow adjusting valve of the spool type having a flow inlet and a flow outlet incorporated in a die casting machine comprising an injection cylinder for activating a plunger by a pressurized oil, a pressurized oil source, a single hydraulic passage through which the oil is supplied from the oil source to the cylinder, so that the single passage includes the valve therein in such arrangement that upstream and downstream portions of the single passage communicate with the flow inlet and the flow outlet, respectively, whereby the injection operation is switched from low speed injection to high speed injection. The valve comprises a valve body having the above flow inlet and outlet and a valve bore being formed with or without a cylindrical sleeve having at least a radial hole, so that the valve bore communicates with the flow inlet and the flow outlet; a valve spool comprised of a cylindrical rod axially slidably mounted in a tight manner in the valve bore for closing and opening the flow outlet by axial forward and rearward movement thereof relative to the valve body; a screw mechanism, preferably a ball screw mechanism, provided at the rear end of the valve body for transforming rotational movement into axial movement; and a motor capable of controlling the amount of rotation, preferably a pulse motor, provided for driving the valve spool via the screw mechanism, so that the valve spool is forced to move in the axial direction relative to the valve body.

7 Claims, 21 Drawing Figures

FLOW ADJUSTING VALVE AND DIE CASTING MACHINE INCORPORATING THE SAME

BACKGROUND OF THE INVENTION

1. Field of the Invention

The present invention relates to a flow adjusting valve and a die casting machine preferably incorporating the valve as a single unit, wherein the valve works to adjust the flow rate in a hydraulic circuit and to switch an injection operation from low speed to high speed.

2. Description of the Prior Art

In the die casting machine, melt is generally injected into the cavity of a metal mold from an injection cylinder at a low speed in the initial stage and at a high speed in the middle stage. The injection of the melt into the die casting machine is usually conducted by drive control of the injection cylinder, which is actuated by hydraulic pressure. To improve the quality of the molded products, low-speed injection must be switched to high-speed injection as quickly as possible and the injection speeds during the low-speed injection and the high-speed injection must be maintained as stably as possible.

In order to automatically adjust the flow rate to some degree, electromagnetic flow adjusting valves of the spool type have heretofore been employed. Electromagnetic flow adjusting valves control the flow rate in proportion to the input current and are equipped with differential transformers to move pilot spools in proportion to a current supplied to the differential transformers. Electromagnetic flow adjusting valves are further interlocked to main spools, so that the flow rate is maintained at a setpoint value. Electromagnetic flow adjusting valves are suitable for adjusting the flow rate to a desired value, but have no means to stop the main spool at a present position. Therefore, upon receipt of an external force, the main spools move back and forth in the axial direction with the present position as a center, whereby the flow rate undergoes variation and the injection speed of the die casting machine is not maintained constant.

In recent years, on the other hand, it has been required to arbitrarily set a pattern of injection speed to meet the metal mold in order to further improve the quality of the molded products. With the conventional flow adjusting valves of the spool type, however, the screw shaft is manually operated to set a flow rate. Therefore, it was impossible to arbitrarily set a pattern of injection speed. For this purpose also, electromagnetic flow adjusting valves of the spool type have also heretofore been used. In the electromagnetic flow adjusting valves of this type, however, the fact that the valve spools are actuated utilizing magnetic force makes it very difficult to precisely and quickly switch a small flow rate of, for example, 10 to 20 liters a minute to a large flow rate of, for example, 50 to 100 liters a minute with a maximum of 15,000 liters a minute, with just a single flow adjusting valve. Therefore, when electromagnetic flow adjusting valves of this type are adapted to a hydraulic circuit for driving the injection cylinder, a separate one must be provided for the small flow rate and for the large flow rate along with a switch valve.

Therefore, conventional electromagnetic flow adjusting valves of this type have not been able to satisfy such requirements as quick switching of injection speed, stable injection speed during the moment of switching, and simplicity of the hydraulic circuit. Accordingly, they have not been well suited for high-speed injection application, which requires stable injection speed and speed changes after short periods of time.

Further, even small amounts of foreign matter which is contained in the operation oil and which is adhered on the pilot spool, causes its movement to be changed and the flow rate to be changed.

Moreover, when the hydraulic circuit is switched, there develops shock in the hydraulic pressure due to the change of pilot lines and change of valves, to disturb operation of the main spool which has no means for mechanically anchoring it at the present position. Accordingly, it becomes difficult to accurately adjust the flow rate. This adversely affects the injection and the quality of the injection-molded products.

According to the conventional art, furthermore, a total of four valves were necessary; i.e., a switch valve for low-speed injection, a flow adjusting valve, a switch valve for high-speed injection, and a flow adjusting valve. Therefore, the hydraulic circuit tended to become complicated, requiring cumbersome control operation.

In connection with the above, it is noted that a flow adjusting valve of the spool type has heretofore been used in which one end of a cylinder chamber or a valve bore formed in the valve body serves as an inlet port for introducing the fluid that is to be controlled, and the opening degree of an outlet path formed in a side portion of the cylinder chamber is adjusted by moving the valve spool which is slidably provided in the cylinder chamber in the axial direction. However, in the conventional flow adjusting valve of this type in which the valve spool slides in direct contact with the inner surface of the valve body, the cylinder chamber must be formed in the valve body requiring a highly precise machining which is difficult to accomplish. Further, since it is difficult to absorb misalignment of axis between the cylinder chamber of the valve body and the valve spool, excessive force is exerted on the valve spool or on the driving portions, making it difficult to smoothly move the valve spool.

SUMMARY OF THE INVENTION

It is therefore a primary object of the present invention to provide a single flow adjusting valve of the spool type in place of the conventional plural valves incorporated in the hydraulic circuit in the die casting machine and eliminating the defects inherent in the conventional art. In other words, the object of the present invention is to provide a flow adjusting valve which is capable of precisely, quickly, and automatically adjusting the flow rate and in which a single valve works as both a flow adjusting valve and a switch valve for low-speed and high-speed injection.

A second object of the present invention is to further enhance the performance of switching the flow rate at high speeds in a flow adjusting valve by reducing the required driving force.

A third object of the present invention is to provide a flow adjusting valve free from the above-mentioned defects and preventing the accuracy for adjusting the flow rate from being decreased by the external force or by the change in temperature.

According to the present invention, there is provided a flow adjusting valve of the spool type, comprising a valve body having a flow inlet and outlet for pressurized oil, the flow rate of which is to be adjusted, and a valve bore communicating with the flow inlet and outlet; a valve spool comprised of a cylindrical rod axially slidably mounted in a tight manner in the valve bore for closing and opening the flow outlet by axial forward and rearward movement thereof relative to the valve body; a screw mechanism provided at the rear end of the valve body for transforming rotational movement into axial movement; and a motor capable of controlling the amount of rotation provided for driving the valve spool via the screw mechanism, so that the valve spool is forced to move in the axial direction relative to the valve body.

The valve may have an axial hollow and a cylindrical sleeve, having at least a radial hole, disposed in the hollow to form in combination therewith the valve bore.

The screw mechanism preferably comprises a casing connected to the valve body at the rear end thereof, an axial nut accommodated in the casing and connected coaxially to the valve spool at the rear end thereof, a screw shaft screwed into the nut, and means for preventing the nut from rotating relative to the valve body.

The flow inlet is designed so that the oil is forced to flow axially into the valve bore through the flow inlet and axially impinge on the forward end of the valve spool, while the flow outlet is positioned relative to the valve spool so that the degree of its opening is increased as the valve spool moves rearward and is so designed that the oil is forced to flow out of the valve bore in a direction perpendicular to the axis into the flow outlet when it is opened. In this case, preferably, the valve bore forms the flow inlet at its forward end and the flow outlet has at least one circumferential groove formed at the inner surface of the valve bore.

The valve bore is preferably separated by the valve spool into two parts forming front and rear valve chambers; at least two axial through-holes and a connecting passage are formed in the valve spool and the valve body, respectively, all so as to communicate the front valve chamber with the rear valve chamber, the through-holes and/or connecting passage having constricted portion; and an oil accumulator is provided so as to communicate with the rear valve chamber; whereby a forward thrust of the valve spool is reduced as the degree of opening of the flow outlet is increased and the axial speed of the valve spool moving rearward is increased.

In the valve with the sleeve disposed therein, the sleeve is disposed in the hollow with a radial gap allowing the sleeve to move radially in the hollow.

Preferably, the rotation preventing means comprises at least an axially extending groove formed by the casing at the inside surface thereof and at least an axially extending radial projection from the nut, the nut projection being disposed axially slidably in the corresponding axial groove. Balls are provided rotatably between the nut and the screw shaft, and the motor is a pulse motor.

In the valve, the valve spool, the sleeve, the valve body, and the screw mechanism have substantially the same thermal elongation percentage.

The valve bore may have a constricted portion having a circumferential standard face perpendicular to the axis the sleeve may be in axial abutment against the standard face at the forward end of the sleeve with an axial gap between the rear end of the sleeve and the screw mechanism. Preferably, the valve spool has axial through-holes therein, compressed axial spring means disposed in the axial gap or a vent hole formed in the screw mechanism through which the standard face is opened to the atmosphere.

Alternatively, the screw mechanism may have a circumferential standard face perpendicular to the axis, the sleeve may be in axial abutment against the standard face at the rear end of the sleeve with an axial gap between the forward end of the sleeve and the valve body. Preferably, the valve spool has axial through-holes therein, a vent-hole formed in the valve body through which the standard face is opened to the atmosphere, or compressed axial spring means disposed in the axial gap.

According to the present invention, the above-mentioned valve is preferably incorporated in a die casting machine comprising an injection cylinder, for activating a plunger by pressurized oil, a pressurized oil source, and a hydraulic circuit having a single oil passage through which the oil is supplied from the oil source to the cylinder. The passage includes the valve therein, whereby the injection operation is switched from low speed injection to high speed injection. The flow inlet communicates with an upstream portion of the oil passage. The flow outlet communicates with the downstream portion of the oil passage.

BRIEF DESCRIPTION OF THE DRAWINGS

The present inveniton can be more fully understood from the following detailed description with reference to the accompanying drawings, in which.

DESCRIPTION OF THE PREFERRED EMBODIMENTS

Figure 1:
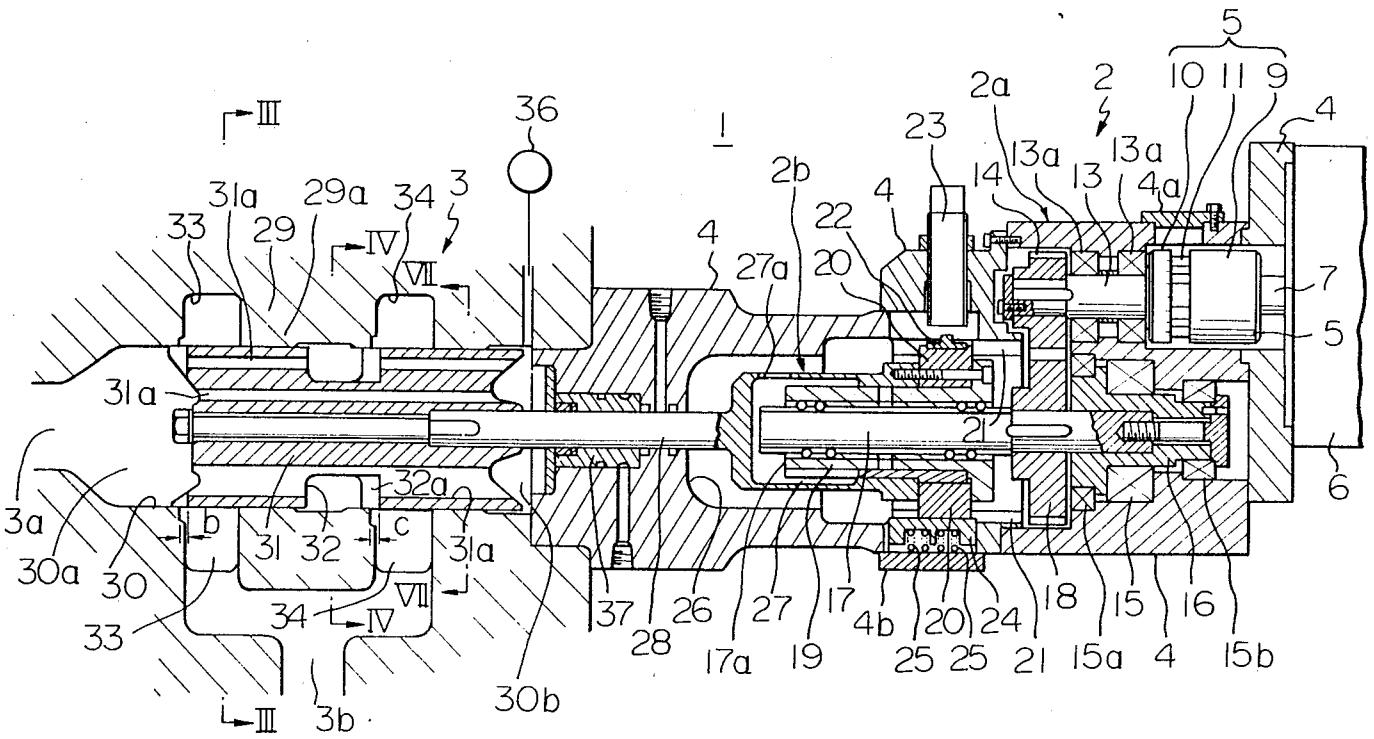
FIG. 1 is a longitudinally sectional view of an embodiment of the valve according to the present invention.
Figure 2:
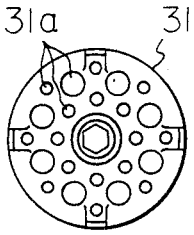
FIG. 2 is a side view of a valve spool in the valve as shown in FIG. 1, taken axially from the forward end of the spool.
Figure 3:
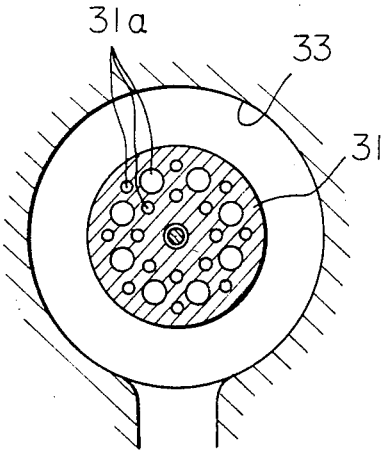
FIGS. 3 and 4 are cross-sectional views taken along lines III—III and IV—IV, respectively, in FIG. 1.
Figure 4:
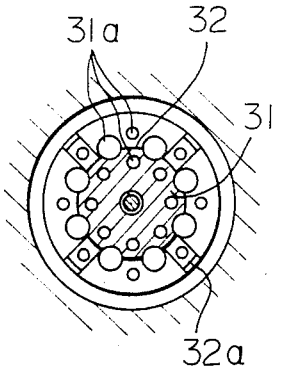

Referring to FIG. 1, a flow adjusting valve 1 of the present invention comprises a drive poriton 2 having a casing 4 accommodating a motor 6, a transmission mechanism 2*a*, and a ball screw mechanism 2*b* and a valve portion 3 including a valve body or manifold 29 having flow inlet 3*a* and outlet 3*b* and valve bore 30 in which a valve spool 31 is axially slidably disposed. The motor 6 is coupled to a gear 14 and the like via a coupling 5 that is provided in a portion of the casing 4. Most preferably, the motor 6 should be a pulse motor that can be automatically controlled quickly and accurately to correctly maintain the position of the valve spool 31. The motor 6 may also be a DC servo motor. Or, when the control is to be effected relatively slowly, the motor 6 may be a combination of an induction motor and a brake. The pulse motor does not move even if force is exerted to run it, but rotated, for the first time, when signals to move it are received in amounts corresponding to the instructed number of pulses. When no running instruction is input, the pulse motor maintains its current position. When a running instruction is input, the pulse motor correctly runs by a predetermined amount at a high speed.

Figure 5:
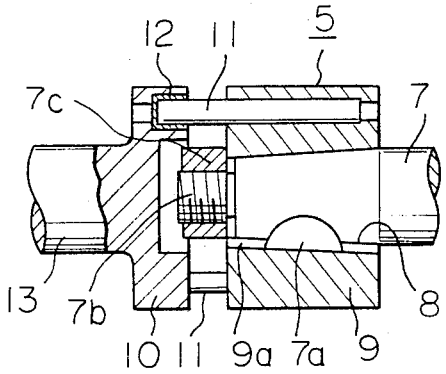
FIG. 5 is an axially sectional view of a coupling in the valve as shown in FIG. 1.

The coupling 5 is constructed as illustrated, for example, in FIG. 5. That is, the coupling 5 has a cylinder 9 with a tapered hole 8, to which a tapered end of a rotary axle 7 of the motor 6 will fit, and has a receiver 10 which is disposed opposite to the cylinder 9, the cylinder 9 and the receiver 10 coupled together by a plurality of pins 11 made of a spring steel or the like. Cushion members 12 composed of teflon or the like are fitted to the holes of the receiver 10 in which the pins 11 are disposed maintaining a predetermined distance relative to one another in the circumferential direction, thereby to constitute a lubrication-free bearing. With reference to the cushion members 12 constituting the lubrication-free bearing, rubber should be applied to the outer periphery of the teflon by baking, and the inner peripheral surfaces should be permitted to be in free contact with the pins 11. Reference numeral 9*a* denotes a key way, 7*a* denotes a cotter, 7*b* denotes a threaded portion at the end of the rotary axle 7, and 7*c* denotes a nut.

In the coupling 5 of this invention, the tapered rotary axle 7 is inserted in the cylinder 9 and is tightened by the nut 7*c*. The pins 11 attached to the cylinder 9 are inserted in the cushion members 12 mounted on the receiver 10, such that the coupling 5 can be mounted or removed very easily. Further, the pins 11 made of straight spring steel rods are inserted in the cushion members 12, such that slight deviation in parallel relation and slight deviation in angle between the rotary axle 7 and the receiver 10 can be absorbed. The coupling 5 of this construction can be very small in size and significantly reduce the inertial force relative to the transmitted torque. In other words, the coupling 5 requires reduced area for installation and is suited for use in the valve device to quickly and reliably effect the switch control and flow control. Although the pins 11 and the receiver 10 are coupled via cushion members 12, they may be coupled via spherical bearings to permit more deflection.

The outer periphery of the receiver 10 is graduated as shown in FIG. 1; the graduates can be read through a clear cover 4*a* provided in a portion of the casing 4, to determine the amount of rotation of the motor 6. The receiver 10 driven by the coupling 5 is formed together with a driven axle 13 as a unitary structure to construct the coupling 5 in a small size. The gear 14 is attached to an end of the axle 13 which is supported by a bearing 13*a* in the casing 4. The gear 14 is in mesh with a gear 18 which is secured to a screw shaft 17 that is supported by bearings or shaft-support members 16 such as thrust bearing 15, ball bearing 15*a*, and tapered roller bearing 15*b*, at the center of the casing 4 in parallel with the axle 13, the shaft 17 is allowed to freely rotate but is not allowed to move in the axial directions. Rotational force of the motor 6 is transmitted to the shaft 17 via the gears 14 and 18. Depending upon the cases, the running axle 7 of the motor 6 may be directly coupled to the shaft 17 or via gears or a belt.

A nut 19 is screwed onto the outer periphery of the shaft 17 on the side of the valve spool 31 via ball screw 17*a*. The nut 19 has a key 20 which is slidably fitted into a key way 21 formed in the casing 4. The nut 19 is allowed to freely advance or retract in the axial directions accompanying the turn of the shaft 17. The shaft 17 and the nut 19 may be engaged together using an ordinary screw provided it permits the nut 19 to move in the axial directions being guided by the key 20 accompanying the turn of the shaft 17. To efficiently move the nut 19, however, the ball screw 17*a* having good transmission efficiency should ideally be used. When the force in the axial direction is exerted on the nut 19 in the device employing ball screw, the shaft 17 is urged to rotate. The shaft 17, however, does not rotate when its turn is prevented by the motor 6. In this respect, permanent magnet 22 is attached to a portion of the key 20 of the nut 19, and a position detector 23, called a zero-cross sensor, which works based upon the magnetic function, is mounted on a portion of the casing 4 opposed to the permanent magnet 22. The position detector 23 is made up of a contactless switch or a lead switch which senses the movement of the permanent magnet 22 and accurately detects moving distances of the nut 19 or the valve spool 31 in the axial directions, to feed back outputs to the control device. Therefore, if the valve spool is axially moved to a predetermined zero position, the motor 6 will cease to rotate the shaft 1.

Further, the nut 19 maintains its center by bringing the lower surface of the key 20 into slidable contact with the upper surface of a receiving plate 24 that is installed in the casing 4 and that moves up and down.

The receiving plate 24 is supported by a cover 4*b* that is attached to the casing 4 via a spring 25 of which the resilient force has been calculated beforehand, whereby the shaft 17 is supported maintaining good balance.

The reason why the above-mentioned construction is employed is to maintain the shaft 17 at the center under horizontal condition, so that the device will smoothly work without exerting a load on the ball bearing in the lateral directions, as well as to eliminate such inconveniences as the difficulty and cumbersomeness of setting the device with the shaft 17 maintained at the center. Further, the whole load is carried by the receiving plate 24 without having the load around the shaft 17 carried by the shaft 17, i.e., the whole load is pushed up by the spring 25 to cancel the load produced by the weight of the device, thereby eliminating deflection and absorbing change in the center of gravity caused by the movement of the nut 19.

Figure 6:
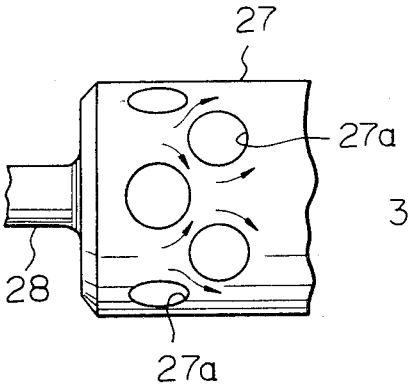
FIG. 6 is a partial front view of a cylindrical enlarged poriton of a connecting shaft in the valve as shown in FIG. 1.
Figure 7:
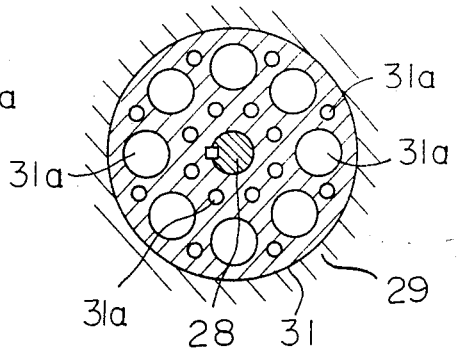
FIG. 7 is a cross-sectional view of the valve spool, taken along lines VII—VII in FIG. 1.

Further, a cylindrical portion 27 greater than the outer diameter of the nut 19 is mounted on the nut 19 as a unitary structure, and a connecting shaft or valve shaft 28 is provided at the tip of the cylindrical portion 27 as a unitary structure. The central axis of the connecting shaft 28 is in agreement with the central axis of the shaft 17. Reference numeral 26 denotes space. A plurality of through holes 27*a* are formed in the cylindrical portion 27 surrounding space 26, the holes 27*a* being formed in a zig-zag manner maintaining a predetermined pitch as shown in FIG. 6. The reason why a plurality of holes 27*a* are formed in the hollow cylindrical portion 27 in a zig-zag manner is because the force transmitted through the connecting shaft 28 escapes along the holes 27*a* as indicated by arrows in FIG. 6, such that the force is dispersed and is not concentrated at a given portion. The cylindrical portion 27 should have a reduced thickness to cope with increased stress. Presence of the holes 27*a* helps the cylindrical portion 27 exhibit increased cushioning effect. Accordingly, reduced impact is given to the ball screws 17*a*. The root portion of the casing 4 accommodating the shaft 17 and nut 19 is mounted on a manifold 29 which forms the valve body by bolts that are not diagrammed. The valve spool 31 is very precisely fitted into the valve bore 30 of the manifold 29 to slide in the axial directions and is further secured to the valve shaft 28. The valve spool 31 has many axial flow holes 31*a* that penetrate therethrough as shown in FIGS. 1, 2, 3, 4 and 7, and are communicated with a hydraulic pump and an accumulator that are not shown. In FIG. 1, further, a first chamber 30*a* on the left side is communicated with a second chamber 30*b* on the opposite side, i.e., on the side of the casing 4. This arrangement was employed for the purpose that the pressure produced by the operation oil and exerted on the connecting shaft 28 or nut 19 via the valve spool 31 in the axial directions is reduced relatively and that the weight of the valve spool 31 is reduced, so that the shaft 17 can be easily turned by the pulse motor 6. Let it now be assumed that the hydraulic pressure in the first chamber 30*a* is P kg/cm$^2$, the sectional area of the valve spool 31 is A cm$^2$ if flow holes 31*a* in the valve spool 31 are omitted, and the sectional area of the valve shaft 28 is a cm$^2$. In this case, if flow holes 31*a* in the valve spool 31 are omitted, the force of $P \times A$ kg will act upon the valve shaft 28. When the valve spool 31 has flow holes 31*a*, however, the valve shaft 28 receives only the force $P \times a$ kg. However, when the valve spool 31 is moving rightward in FIG. 1, the oil in the second chamber 30*b* flows into the first chamber 30*a* through flow holes 31*a*. In this case, therefore, the hydraulic pressure in the second chamber 30*b* becomes higher than the hydraulic pressure P in the first chamber 30*a* by $\Delta P$ though it may last only temporarily. Therefore, the force acting upon the valve shaft 28 is further reduced as given by $A \cdot P - (A-a) \cdot \Delta P$, and impact is further reduced. With flow holes 31*a* being formed, the valve spool 31 can be opened with a relatively small force and can also be closed with a relatively small force. This matter will be further discussed in more detail hereafter with reference to FIGS. 14 to 21.

When no flow hole 31*a* is formed in the valve spool 31, a small accumulator 36 is coupled to the second chamber 30*b*, so that the oil in the second chamber 30*b* escapes when the valve spool 31 has moved, that the valve spool 31 moves smoothly, and that reduced impact is given to the valve shaft 28. It is also possible to communicate the first chamber 30*a* with the second chamber 30*b* via a conduit or a flow path that run outside the valve body, instead of forming flow holes 31*a* in the valve spool 31. The flow inlet 3*a* is preferably designed as indicated in FIG. 1 so that the oil is forced to flow into the valve bore 30 through the flow inlet 3*a* and axially impinge on the foward end of the valve spool 31 and flow into the flow holes 31*a* smoothly, while the flow outlet 3*b* is designed so that the oil is forced to flow out of the valve bore 30 in a direction perpendicular to the axis into the valve bore 30 when the valve is opened.

A circumferential groove 32 is formed in the outer peripheral surface at the central portion of the valve spool 31, so as to be communicated with the flow holes 31*a*.

Further, a throttle portion 29*a* is formed on the side of the manifold 29 thereby to define holes 33 and 34 for flowing operation oil to the secondary side, i.e., to the side of the injection cylinder. As the valve spool 31 moves, the flowing condition changes between the groove 32 and the valve spool 31, and whereby the flow rate is changed.

The groove 32 is formed in the valve spool 31 to communicate with the first chamber 30*a*, and flow holes 33, 34 are formed in the manifold 29, such that oil is allowed to flow as much as possible with a reduced opening degree of the valve spool 31. That is, the oil is allowed to flow from the first chamber 30*a* to the flow hole 33 through the end portion of the valve spool 31, and, at the same time, the oil in the first chamber 30*a* is allowed to flow into the flow hole 34 through the groove 32 and cut-away portion 32*a*, under the condition illustrated in FIG. 1. It is, of course, allowable to provide two or more grooves 32, and two or more flow holes 34 to correspond thereto. This enables the diameter of the valve spool to be reduced and the valve device to be constructed in a reduced size as a whole. If the opening degrees of the flow holes 33, 34 when the valve spool 31 is opened to its maximum degree are denoted by b and c, the opening degrees b, c may be selected to be equal to each other, i.e., $b=c$, so that the oil flows at the same rate through the two clearances. Or, the opening degrees may be selected maintaining a relation $c>b$, so that when a low-speed injection is to be performed at a small opening degree, the flow hole 33 is shut off and the oil is permitted to flow into the flow hole 34 from the groove 32, and when a high-speed injection is to be performed at an increased opening degree, the oil flows through the two flow holes 33 and 34.

Figure 8:
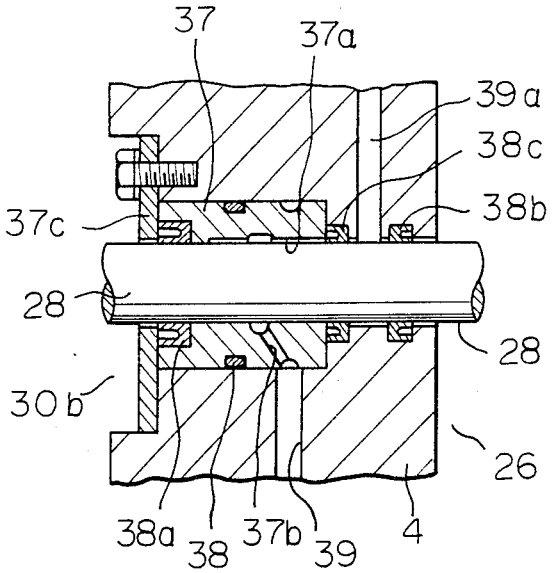
FIG. 8 is an axial partial sectional view of a bearing portion, including a shaft-sealing member, of a screw mechanism in the valve as shown in FIG. 1.

Further, a shaft-sealing member 37 having a draining function is provided between the casing 4 about the valve shaft 28 and the chamber 30*b* on the side of the bore 30, as shown in FIGS. 1 and 8. The shaft-sealing member 37 has a cylindrical shape. Its inner peripheral surface is highly precisely finished to completely seal the valve shaft 28, but its outer peripheral surface is finished relatively roughly. A packing 38 is provided on the outer peripheral surface of the shaft-sealing member 37, and the casing 2 is fitted via the packing 38. Further, as illustrated in detail in FIG. 8, a small space 37*a* is formed relative to the packing 38*a* provided on the side of the second chamber 30*b* in the inner peripheral surface of the shaft-sealing member 37. The space 37*a* is communicated with a drain hole 39 formed in the casing 4 via a hole 37*b* that penetrates through the shaft-sealing member 37, and is open to the external side of the device. Reference numerals 38*b*, 38*c* denote packings provided on the side of the space 26; 39*a* denotes a drain hole formed in the casing 4 between the two packings 38*b*, 38*c*; and 37*c* denotes a holder plate.

The above-mentioned shaft-sealing member is employed because of the reasons mentioned below. That is, a lubricating oil composed of a mineral oil such as turbine oil is supplied into space 26 on the side of nut 19, while a non-combustible operation oil which is called water-glycol is frequently supplied into the second chamber 30*b* on the side of bore 30. If these oils having different properties leak and mix together, the operation becomes defective. Therefore, in case the oil on the bore 30 side partly leaks through the packing 38*a*, the leaked oil is reliably drained through the drain hole 39 after having lubricated the inner peripheral surface of the shaft-sealing member 37 and the outer peripheral surface of the valve shaft 28. In case the oil on the space 26 side partly leaks through the packing 38*b*, the leaked oil is reliably drained through the drain hole 39*a*.

Further, the packing 38 is fitted to the outer periphery of the shaft-sealing member 37 which is engaged with the casing 4. Thus, only the valve shaft 28 need be finished highly accurately. The outer peripheral surface need only be roughly finished.

Moreover, the double-packing system is employed to attain improved sealing performance while providing flexibility to some extent in the direction at right angles with the axial line.

Figure 9:
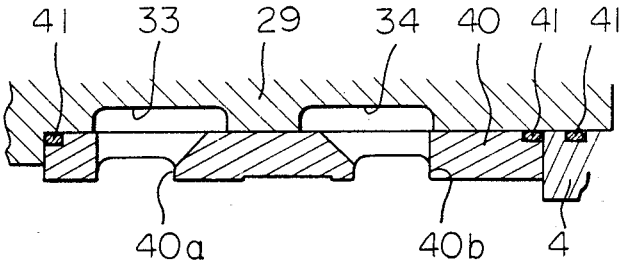
FIG. 9 is a partial sectional view of another embodiment of the valve according to the present invention, wherein a cylindrical sleeve and a valve body are combined to form a valve bore.

The portion of the manifold 29 contacting the valve spool 31 can be constructed as illustrated in FIG. 9. Namely, in FIG. 9, the manifold 29 has a double construction in which a sleeve 40 is fitted to the inner side, the sleeve 40 being in direct contact with the valve spool 31. The sleeve 40 has through holes 40*a*, 40*b* that are communicated with the flow holes 33, 34, respectively. The inner peripheral surface of the sleeve 40 and the valve spool 31 are finished relatively severely, so that the operation oil will not leak through the clearance between the valve spool 31 and the sleeve 40 and will flow into the flow holes 33, 34, even when a large hydraulic pressure is applied.

The outer peripheral surface of the sleeve 40 and the inner peripheral surface of the manifold 29 are finished relatively roughly. Leakage of oil through the clearance between the manifold 29 and the sleeve 40 is prevented by packings 41 such as 0-rings. By employing this construction, only the inner peripheral surface of the sleeve 40 need be finished highly accurately like the above-mentioned case of shaft-sealing member 37, thus simplify the machining operation and presenting a great advantage in economy. That is, when the valve spool 31 is to be slidably inserted in the manifold 29, it is necessary to form a hole in the manifold 29 with high precision, requiring cumbersome and laborious work. When the valve spool 31 is inserted in the manifold 29 via sleeve 40, however, the hole need be formed in the manifold 29 with a precision which is several times as rough as the above-mentioned case. Only the inner peripheral surface of the sleeve 40, which can be easily machined, need be severely finished. Further, provision of a sleeve 40 sufficiently absorbs small deviations in axis, making it possible to properly maintain the axis to meet the movement of the valve spool 31, so that excessive force will not act upon the valve spool 31 and the like.

Next, operation of the thus constructed embodiment will be described below. First, when a die casting machine to which the flow adjusting valve is applied is in an inoperative condition, the valve spool 31 advances leftward in FIG. 1, and the flow holes 33, 34 of the manifold 29 are not in communication with the first chamber 30*a* and the groove 32 of the valve spool 31. Under this condition, if the motor 6 is operated to initiate the low-speed injection and to specify the low-speed injection, the pulse motor 6 rotates by a predetermined angle and its rotational force is transmitted to the shaft 17 via shaft 13, gear 14, and gear 18. Rotation of the shaft 17 is transmitted to the nut 19 via a ball-screw means which is provided between the shaft 17 and the nut 19, i.e., the nut 19 retracts. The retracting motion of the nut 19 is transmitted to the valve spool 31 via the valve shaft 28, so that the groove 32 is communicated with the flow hole 34. Then, operation oil of the primary side introduced into the bore 30 side at the end of the valve spool 31 flows into the flow hole 34 via groove 32 and is supplied into an injection cylinder (not shown), so that the low-speed injection is initiated. In this case, the flow degree between the groove 32 and the flow hole 34, i.e., the flow rate of operation oil, has been correctly set to meet the injection cylinder of the die casting machine.

In the present embodiment, the front and rear portions of the valve spool 31 communicate together via a flow hole 31*a*. When the valve spool 31 is not in operation, therefore, the pressure is the same in the first chamber 30*a* of the front end side and the second chamber 30*b* of the back side. As the valve spool 31 retracts, however, the operation oil in the second chamber 30*b* is compressed, and the pressure of the bore 30 side becomes slightly less than the pressure of the chamber 30*b* side. When the hydraulic pressure is exerted on the front end of the valve spool 31, the nut 19 is pushed via the valve spool 31, i.e., the nut engaged via the ball screw is constantly urged rearward.

Therefore, the backlash inherent in every form of engagement is eliminated, and the flow rate can be adjusted highly accurately.

The condition of low-speed injection is thus set and is maintained for a predetermined period of time. Then, when high-speed injection is required, the motor 6 rotates to turn the shaft 17, whereby the nut 19 is further retracted. Since the nut 19 retracts very smoothly and at a high speed via the ball screw, the valve spool 31 retracts at a high speed.

As the valve spool 31 retracts to a predetermined position, the area in which the groove 32 is communicated with the flow hole 34 further increases, and the area in which the bore 30 at the end of the valve spool 31 is communicated with the flow hole 33 expands abruptly. Accordingly, a large amount of operation oil is sent into the injection cylinder via flow holes 33, 34, and the high-speed injection is assumed instantaneously. When the high-speed injection is finished, the motor 6 is operated again to close the valve spool 31.

By applying a desired number of pulses to the pulse motor, the amount of rotation of the motor is controlled to accurately, quickly, and automatically open and close the flow adjusting valve and to adjust the degree of opening.

When the valve is opened to a desired amount, disturbance such as shock in hydraulic pressure caused by the change in pressure in the hydraulic circuit or by the switch of valves may act upon the valve spool to move it in the axial direction. However, the valve spool which is coupled to the motor via the nut and screw shaft, is not affected by the disturbance at all. That is, the valve spool does not move in the axial directions unless it is actuated by the motor. Accordingly, the flow rate is maintained very stably, and the injection speed is maintained constant. Using the above-mentioned device, therefore, the molten metal can be injected under a good condition, and injection-molded products of good quality can be obtained reliably and easily.

Further, a single flow adjusting valve offers four valve functions, i.e., flow adjusting valve and switch valve for low-speed low-speed injection, and flow adjusting valve and switch valve for high-speed injection. Therefore, there is no need of providing a plurality of valves to produce the above-mentioned functions and, hence, the whole construction of the injection machine is very simplified, the size is reduced, and length of the conduit or oil passage for hydraulic pressure is shortened, to provide great advantage in economy.

Further, to adjust the flow rate, rotation of the motor is converted into change in stroke of the valve spool making it possible to automatically move the valve spool at a very high speed maintaining precision. Therefore, the low-speed injection can be switched into a high-speed injection maintaining good response characteristics, accurately and at a high speed, enabling the high-speed injection operation to be reliably controlled.

The valve spool and the nut which is advanced or retracted by the turn of the motor are constructed as a unitary structure, and the hydraulic pressure of a predetermined direction is always acted upon the valve spool. Hence, there is no backlash between the nut and the threaded shaft with which the nut engages, and the flow rate is accurately controlled. Therefore, the flow adjusting valve of the present invention can be employed as a valve through which pressurized oil at a relatively large flow rate of, for example, 50 liters/min. with a maximum of 15,000 liters/min. is allowed to pass and which can smoothly and rapidly open or close by movement of only a main spool.

If a plurality of flow holes are formed circumferentially in the valve spool at an equal distance along the axial line, the force acting upon the valve shaft can be reduced, the weight of the valve spool can be reduced, and members for driving the valve spool can be smoothly moved. Moreover, the position of the valve spool is not varied by the disturbance produced in the hydraulic circuit and the flow rate is not changed, i.e., the flow rate is accurately controlled.

The coupling portion between the nut and the valve shaft of valve spool should be made of a hollow cylinder with many openings that are arrayed in a zig-zag mannner, so that the hydraulic pressure transmitted from the side of the valve spool is dispersed along the openings, i.e., so that the force is uniformly transmitted and stress is not concentrated at one place, to avoid breakage. Further, this construction produces a cushioning effect to reduce the load exerted on the nut.

If at least two or more flow holes are formed in the manifold along the axial directions to be communicated with the chamber at the end of the valve spool and with the flow holes of the valve spool, the flow rate can be controlled over an increased range while reducing the diameter of the valve spool.

By providing a position detector which detects the position of nut to detect where the valve spool is located, it is possible to prevent the problems associated with excess movement of the nut by monitoring the position of the nut.

Moreover, if a flexible coupling of a special construction mentioned above is provided between the motor and the shaft, inclination of the shaft can be absorbed, and the excessive force is not exerted.

By employing the above-mentioned particular construction, a single flow adjusting valve exhibits many valve functions, making it possible to accurately and reliably control the flow rate and to open and close the valve without being affected by disturbance.

Following the above-mentioned embodiment involving the sleeve as shown in FIG. 9, other embodiments will be described with reference to FIGS. 10 to 13.

Figure 10:
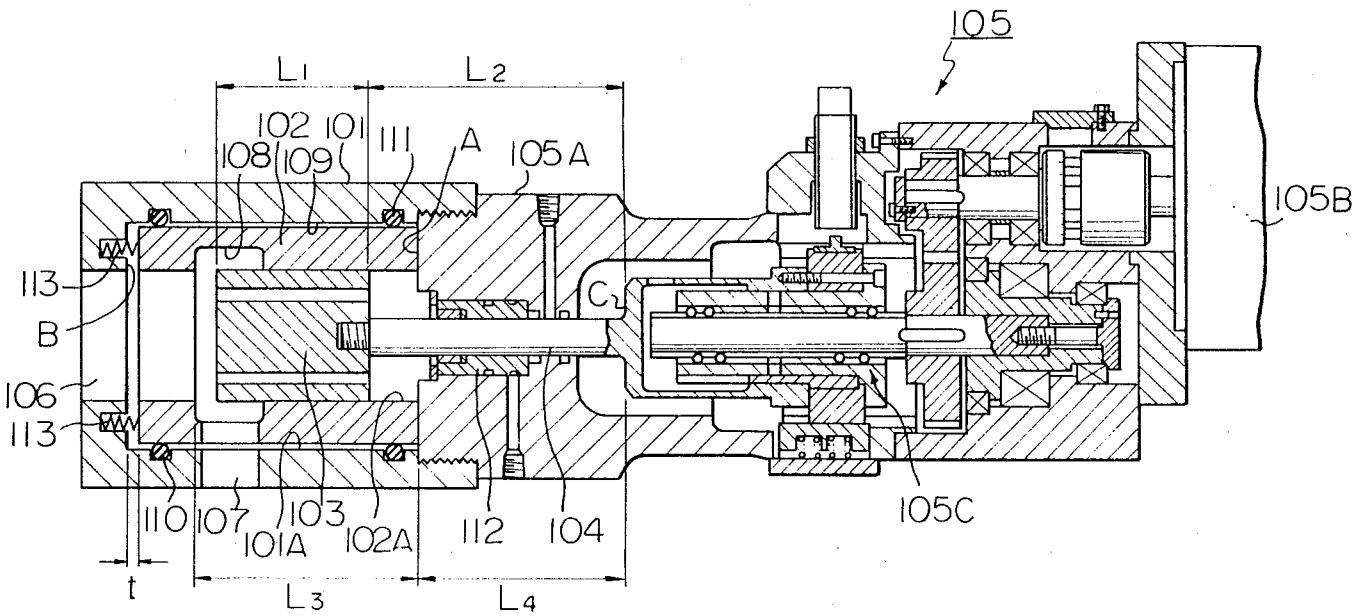
FIG. 10 is a longitudinal sectional view of an embodiment of a valve portion in a combination of the valve body and the valve spool with a cylindrical sleeve in the valve according to the present invention.

FIG. 10 illustrates another embodiment of the present invention, in which a flow adjusting valve has a valve body 101, a cylindrical sleeve 102 which is accommodated in the valve body 101 and which is allowed to move in the axial direction, and a valve spool 103 which is slidably fitted into the inner surface 102A of the sleeve 102. The valve spool 103 is coupled to a drive device 105 via a drive shaft 104. The drive device 105 is fastened to the valve 101, and the drive shaft 104 is slidably supported by a casing 105A of the drive device 105 which is energized by the rotational output of motor 105B to drive the drive shaft 104 in the axial direction via a ball-screw mechanism 105C.

The valve body 101 has an inlet port or flow inlet 106 and an outlet port or flow outlet 107 for introducing and draining the fluid that is to be controlled. An outlet path 108 is formed in the inner surface 102A of sleeve 102 in the circumferential direction so as to be communicated with the outlet port 107. To adjust the flow rate, the opening degree of the outlet path 108 is adjusted by moving the valve spool 103 in the axial direction. Here, the outlet path 108 can be closed relative to the inlet port 106 by the valve spool 103. That is, the flow adjusting valve also works as a switching valve.

Here, the inner surface 102A of the sleeve 102 must be finished highly precisely to fit to the valve spool 103. The inner surface of the cylindrical sleeve 102, however, can be easily and highly precisely machined using a turning tool or the like. On the other hand, the inner surface 101A of valve body 101 need not be highly precisely machined, and can therefore be finished easily. A suitably degree of radial gap 109 may be formed between the inner surface 101A of valve body 101 and the outer peripheral surface of sleeve 102, in order to absorb misalignment of axis of the valve spool 103 relative to the valve body 101. Therefore, the axis of sleeve 102 can be brought into strict agreement with the axis of valve spool 103. Thus, the valve spool 103 can be smoothly and quickly moved. Reference numerals 110, 111, and 112 denote sealing members.

Since a gap t is maintained between the sleeve 102 and the valve body 101, thermal expansion of the sleeve 102 in the axial direction can be absorbed by the gap t. Due to the presence of the gap t, however, the sleeve 102 may move in the axial direction relative to the valve body 101. According to this embodiment, however, the sleeve 102 is always urged by springs 113 onto one side of the valve body 101 in the axial direction and, hence, does not move in the axial direction even when an external force is exerted thereon. In other words, opening degree of the outlet path 108 is not affected by the external force.

The sleeve 102 can be pressed onto one side of the valve body 101 in the axial direction in the following two ways. That is, the sleeve 102 is pressed onto the casing 105A or onto a reference surface A of valve body 101, or the sleeve 102 is pressed onto a reference surface B. In the above-mentioned embodiment, however, the sleeve 102 is pressed onto the reference surface A of the valve body 101. Namely, the direction in which the sleeve 102 may expand by the heat is set to be the same as the direction in which the valve spool 103 and the drive shaft 106 may extend from a reference position C.

In the thus constructed device, if the fluid to be controlled has a high temperature, the sleeve 102 stretches toward the reference surface B due to thermal expansion. The valve spool 103 and the drive shaft 104 also stretch in the same direction as the sleeve 102 due to thermal expansion and, hence, the opening degree of the outlet path 108 changes very little. Theoretically, the opening degree of the outlet path 108 does not change all if the parts have the same coefficient of thermal expansion and are heated at the same temperature. Therefore, by taking into consideration the difference between the size $L_4+L_3$ and the size $L_1+L_2$ that will be caused by the difference in temperature distribution, the sleeve 102, valve spool 103, and drive shaft 104 should have different coefficients of thermal expansion corresponding to the difference in size, such that opening degree of the outlet path 108 is maintained constant. In this case, only the viscosity index of the fluid caused its flow rate to change depending upon the change in temperature. Accordingly, the flow rate can be stably maintained if the moving amount of the valve spool 103 driven by the drive device 105 is corrected depending upon the viscosity index that changes depending upon the temperature.

Figure 11:
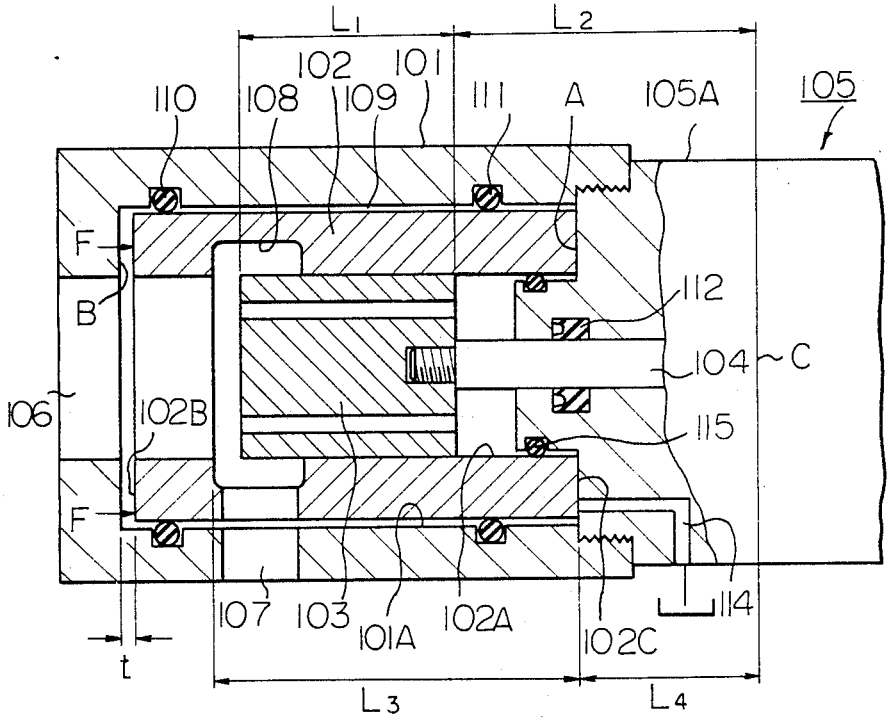
FIGS. 11, 12, and 13 are axial sectional views of parts of other embodiments of the combination of the valve body and valve spool with the sleeve according to the present invention.

FIG. 11 illustrates still another embodiment of the present invention, in which the same reference numerals as those of FIG. 10 denote the same constituent elements as those of the above-mentioned first embodiment.

In this embodiment, the sleeve 102 is pressed onto the reference surface A like the embodiment of FIG. 10. However, what makes the second embodiment different from the embodiment of FIG. 10 is that the sleeve 102 is pressed onto the reference surface A by utilizing the pressure of the fluid that is to be controlled. That is, the pressure F of the fluid to be controlled is acted upon the end surface 102B of sleeve 102 that is opposed to the reference surface B, and the side of the end surface 102C of sleeve 102 opposed to the reference surface A is opened to a tank or to the open air via a path 114. Reference numeral 115 denotes a sealing member for sealing the interior of the sleeve 102 from the open air.

This embodiment produces the same effect as the above-mentioned embodiment of FIG. 10 and further gives such an advantage that no spring is used to press the sleeve 102 onto one side in the axial direction, so that the number of parts can be reduced.

Figure 12:
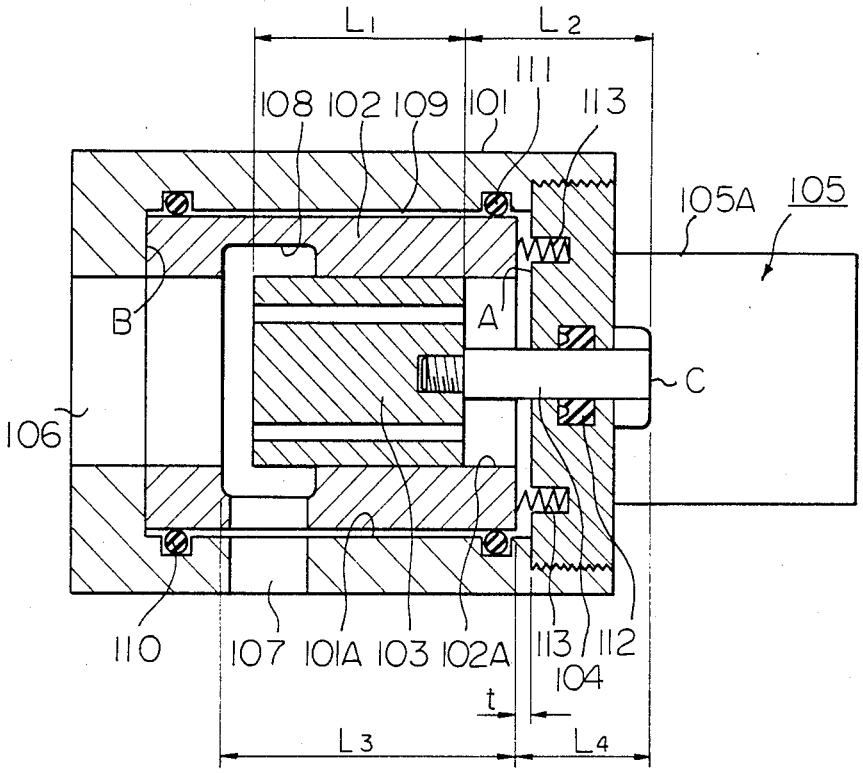

FIG. 12 illustrates still another embodiment of the present invention, in which the same reference numerals as those of FIG. 10 denote the same constituent elements as those of the embodiment of FIG. 10.

In this embodiment, the sleeve 102 is pressed onto the reference surface B by springs 113, unlike the embodiments of FIG. 10 and 11.

In the case of this embodiment, therefore, the sleeve 102 is prevented from moved by the external force like the embodiments of FIGS. 10 and 11. However, the direction in which the sleeve 102 moves due to thermal expansion is opposite to the direction in which the valve spool 103 and the drive shaft 104 stretch due to thermal expansion. Therefore, as the temperature of the fluid to be controlled rises, opening degree of the outlet path 108 decreases due to the thermal expansion of the sleeve 102, valve spool 103 and drive shaft 106. However, reduction in the opening degree of the outlet path 108 is rather desirable since the viscosity of the fluid decreases and the flow rate increases as the temperature of the fluid rises. That is, the flow rate of the fluid can be prevented from changed by the change in temperature if coefficients of thermal expansion of the sleeve 102, valve spool 103, and drive shaft 104 are so selected that the opening degree of the outlet path 108 is decreased by an amount corresponding to the increment of flow rate caused by the reduced viscosity of the fluid. The temperature of the flow adjusting valve is changed most dominantly by the temperature of the fluid to be controlled. According to the valve constructed according to this embodiment, therefore, the flow rate can be stably maintained without the need of controlling the drive device responsive to the change in temperature.

Figure 13:
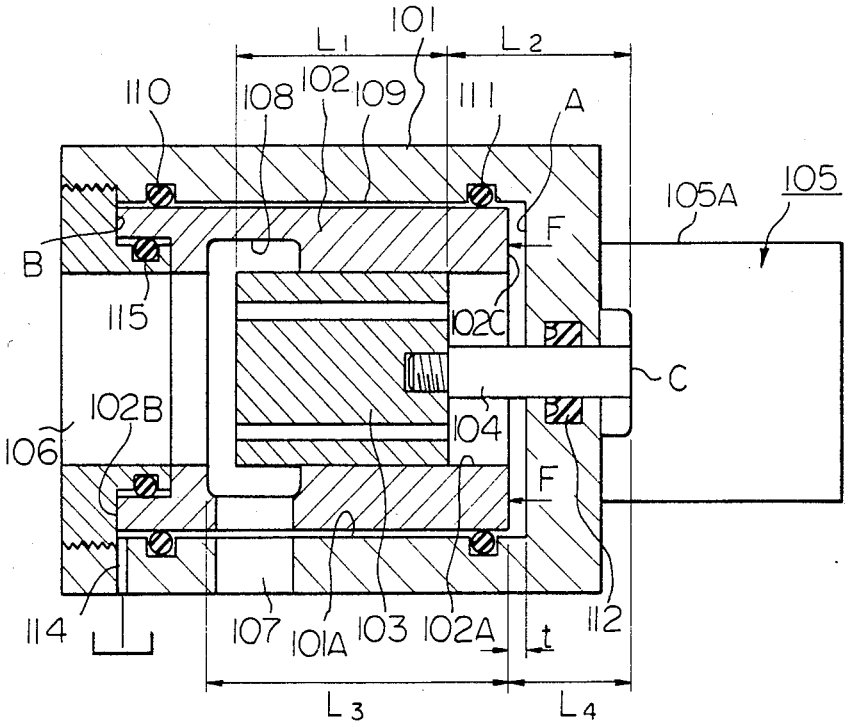

FIG. 13 illustrates still another embodiment of the present invention, in which the same references as those of FIGS. 10 and 12 denote the same constituent elements as those of the embodiments of FIGS. 10 and 12.

In this embodiment, the sleeve 102 is pressed onto the reference surfacc B like the embodiment of FIG. 12. However, what makes this embodiment different from the embodiment of FIG. 12 is that the sleeve 102 is pressed onto the reference surface B by utilizing the pressure of the fluid to be controlled. That is, in this embodiment, the pressure F of the fluid to be controlled is acted upon the end surface 102C of the sleeve 102 opposed to the reference surface A, and the side of the end surface 102B of the sleeve 102 opposed to the reference surface B is opened to the tank or to the open air via a path 114. Reference numeral 115 denotes a sealing member for sealing the interior of the sleeve 102 from the open air.

This embodiment produces the same effect as the above-mentioned embodiment, of FIG. 12 and does not require springs for pressing the sleeve 102 onto one side in the axial direction just as in the embodiment of FIG. 11, making it possible to reduce the number of parts.

Although various embodiments were mentioned in the foregoing, it should be noted that the drive device is in no way limited to the one which is shown in FIG. 10. Further, means for pressing the sleeve onto one side in the axial direction may be constructed in a manner other than the above-mentioned embodiments.

FIGS. 14 to 21 are intended to show first and second flow adjusting valves of the present invention with dynamic forces exerted to the valve spools incorporated in the valves and to explain methods of controlling flow adjusting valves which are suited for adjusting the flow rate in a hydraulic circuit of a die casting machine.

Figure 14:
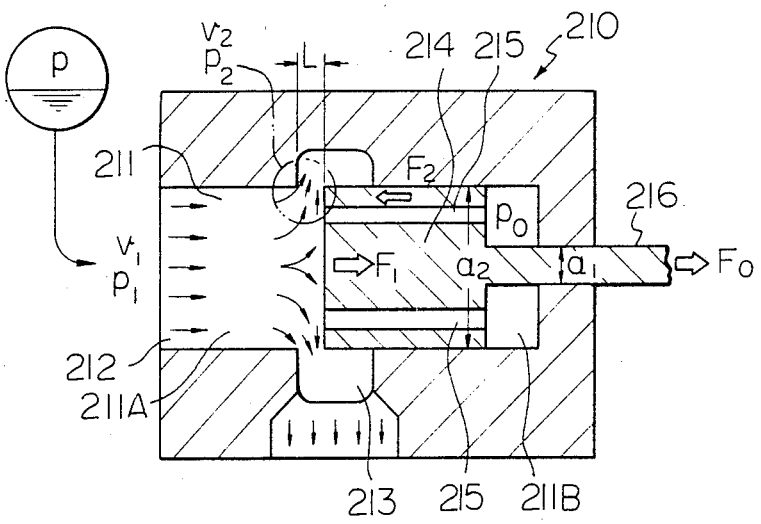
FIG. 14 is an axial sectional view of a part of an embodiment of a valve portion in the valve according to the present invention.

FIG. 14 schematically illustrates major portions of the first flow adjusting valve of the present invention. In FIG. 14, a valve body 210 has a cylinder chamber 211. One end of the cylinder chamber 211 forms an inlet port 212 for introducing the fluid that is to be controlled. An outlet path 213 for flowing out the fluid to be controlled is formed in the side of the cylinder chamber 211 along the circumferential direction. A valve spool 214 is slidably fitted in the cylinder chamber 211. That is, the cylinder chamber 211 is divided by the valve spool 214 into a chamber 211A on the side of the inlet port 212 and a chamber 211B on the other side. A through hole 215 is formed in the valve spool 214 to communicate the two chambers 211A, 211B with each other.

A drive rod 216 which is formed together with the valve spool 214 as a unitary structure is coupled to a drive device that is not diagrammed. Although there is no particular limitation, the drive device should be of the type in which the rotational speed of the motor is reduced through a reduction mechanism and is converted, via a ball-screw mechanism, into the force for driving the drive rod 216 and the valve spool 214 in the axial direction. In this case, it is recommended to use a pulse motor. It is, however, allowable to use a DC motor or to employ a combination of an induction motor and a brake. Owing to the drive device, the valve spool 214 can be moved in the axial direction at high speeds and can be stopped at any desired position. The flow rate of the fluid is controlled by adjusting the opening amount of the valve spool 214, i.e., by adjusting the opening amount of the outlet path 213 relative to the cylinder chamber 211. Here, the opening amount of the outlet path 213 relative to the cylinder chamber 211 can be brought to zero by the valve spool 214, so that the flow adjusting valve will work as a switching valve. The flow adjusting valve, however, needs not have a function to stop the flow.

With the thus constructed flow adjusting valve, the flow rate can be adjusted over a range of from a small flow rate to a large flow rate of, for example, a maximum of about 15,000 liters a minute. When the flow adjusting valve is to be adapted to a hydraulic circuit for driving the injection cylinder of a device for injecting the melt, the inlet port 212 of the flow adjusting valve is communicated with a hydraulic-pressure source 217, and the outlet path 213 is communicated with an injection cylinder that is not diagrammed.

The method of controlling the flow adjusting valve will be described below with reference to FIGS. 14 to 19.

Figure 15:
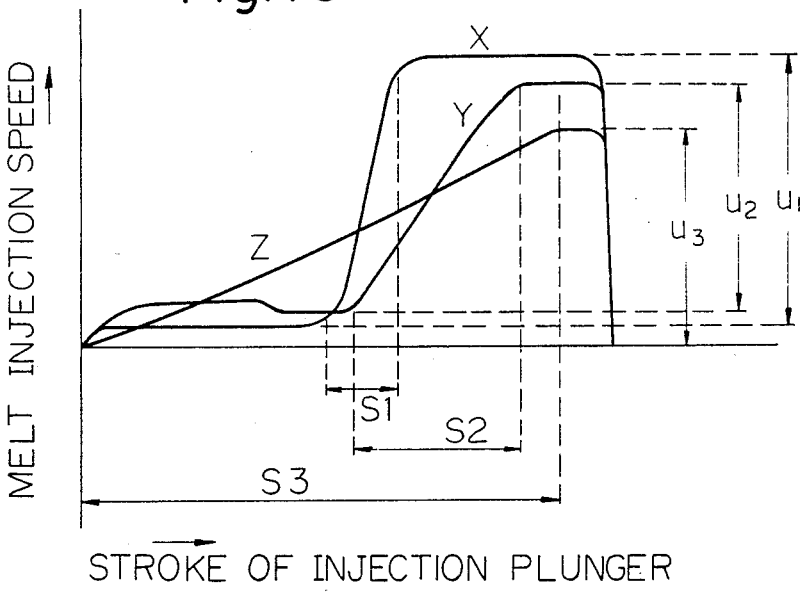
FIG. 15 is a diagram of patterns which represent relations between the melt injection speed of the die casting machine and the stroke of the injection plunger.

Referring to FIG. 15, relations between the injection speed and the stroke of plunger in a die casting machine can, generally, be grouped into patterns as represented by curves X, Y, and Z. Among these patterns, the severest conditions are required for the flow adjusting valve in the case of the pattern X. It is because, the stroke $s_1$ of the plunger is the smallest while the change of speed $u_1$ is large. That is, since there exists a relation $u_1/s_1$ $u_2/s_2 > u_3/s_3$, the high-speed switching ability required for the flow adjusting valve is given by a relation $X > Y > Z$.

As mentioned above, when high-speed switching performance is required for the flow adjusting valve, the valve must be opened abruptly from a region of small flow rate to a region of large flow rate. In this case, the relation between the moving speed of the valve speed and the opening amount changes as indicated by a pattern A of FIG. 16. To obtain such a pattern A, in general, large force is needed in the acceleration and deceleration regions, the direction of the force being reversed depending upon the acceleration or deceleration. The feature of the first invention valve is to reduce the driving force required for switching the flow rate at high speeds by abruptly reducing the thrust of valve spool produced by the fluid to be controlled with the increase in the opening amount of the valve spool.

That is, according to the first valve, the fluid to be controlled having a velocity of flow $v_1$ and a pressure $p_1$ is allowed to act upon one end surface of the valve spool 214 so that the valve spool 214 will produce the force $F_1$ ($F_1 = v_1, p_1$) in the opening direction, and the flowing characteristics are so changed as to assume a velocity of flow $v_2$ ($v_2 > v_1$) and a pressure $p_2$ ($p_2 < p_1$) by the throttle function established near the circumference at one end of the valve spool 214, such that the valve spool 214 will produce the force $F_2$ in the closing direction being assisted by a pressure $p_0$ in the chamber 211B. Further, the valve spool 214 produces a force $F_0$ (approximately $F_0 = p_1 \cdot a_1$, where $a_1$ denotes a sectional area of the drive rod 216) in the opening direction due to difference in the pressure-receiving areas of both ends of the valve spool 214.

Figure 17:
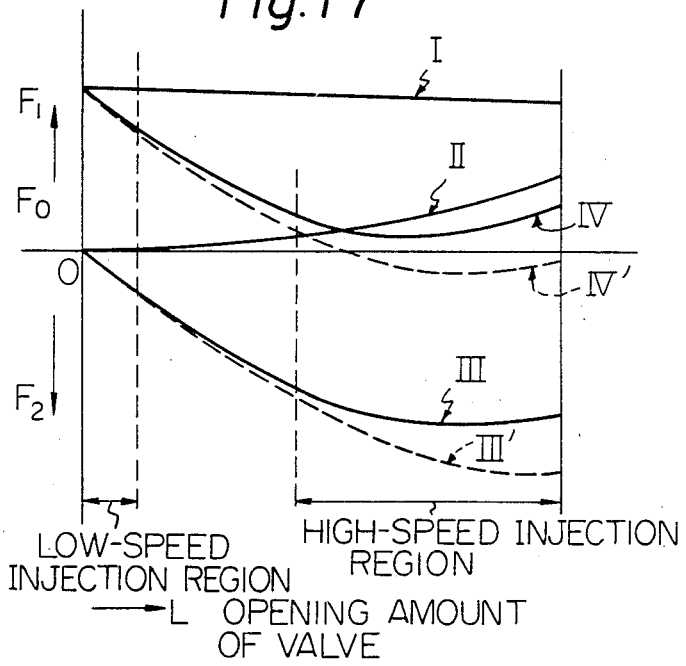
FIG. 17 is a diagram of the relations between the axial thrust of the valve spool and the opening amount of the valve spool, generated by the fluid to be controlled, according to a method of the present invention.

In FIG. 17, curves I, II, and III of solid lines represent changes of the forces $F_0$, $F_1$ and $F_2$ relative to the opening amount of the valve spool 214, and a curve IV represents change of thrust ($F_0 + F_1 + F_2$) of the valve spool 14 in the axial direction consisting of the sum of these forces. If the force $F_2$ is changed as indicated by a curve III' of broken line, the thrust in the axial direction changes as represented by a curve IV'. Part of the thrust IV' in the axial direction is reversed for its direction when the opening quantity of the valve spool 214 becomes greater than a predetermined value. This state is encompassed in the meaning of reduction of thrust of axial direction referred to in the present invention.

Figure 16:
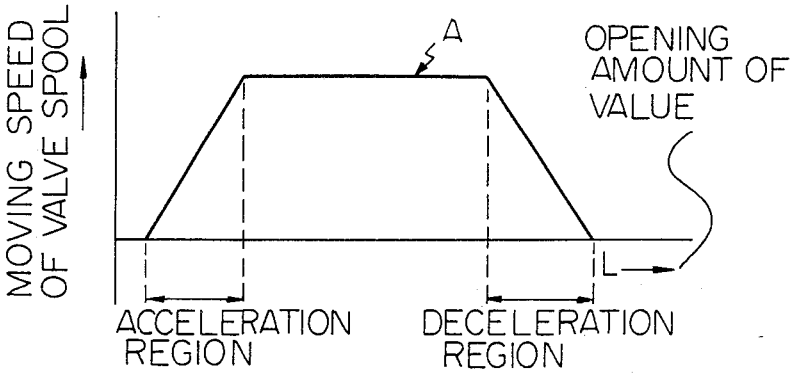
FIG. 16 is a diagram of the relation between the moving speed of the valve spool and the opening amount of the valve spool, or the degree of its opening, when the flow adjusting valve installed in the hydraulic circuit for driving the injection plunger is operated at a high speed to switch the flow rate.
Figure 18:
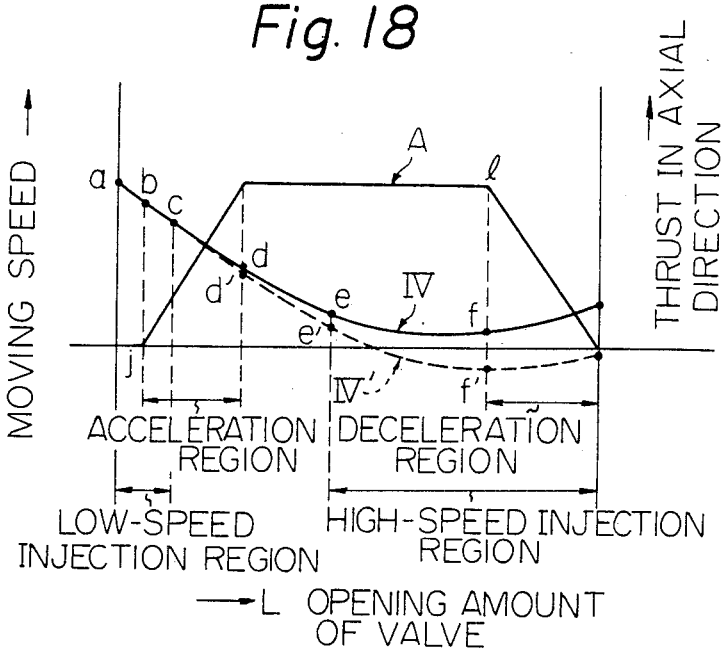
FIG. 18 is a diagram in which the axial thrust characteristics of FIG. 17 are superposed on the diagram of the moving speed of the valve spool of FIG. 16.
Figure 19:
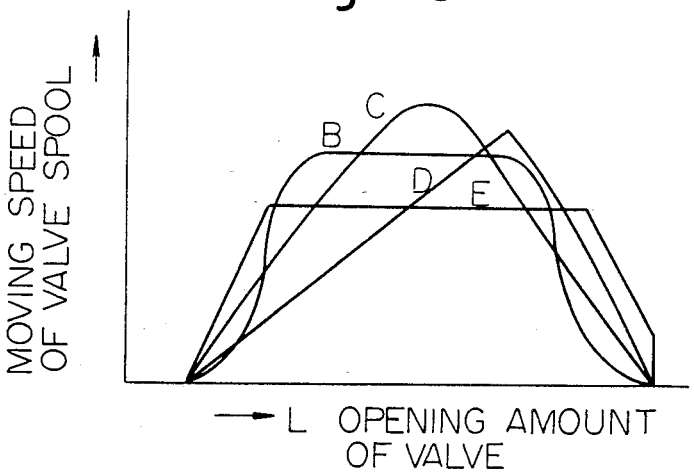
FIG. 19 is a diagram of patterns which represent changes of the moving speed of the valve spool.

FIG. 18 shows a relation between the pattern A of moving speed of the spool 214 of FIG. 16 and the thrust characteristics IV, IV' the axial direction of FIG. 17. In FIG. 5, the section between j and k in the pattern A of moving speed of valve spool 214 represents an acceleration region, and the section between 1 and m represents a deceleration region for bringing the valve spool 214 into halt. If the thrust characteristics IV in the axial direction are corresponded to the pattern A, the axial thrust works in the opening direction as denoted by b-c-d in the acceleration region j-k. Since the thrust is added to the force for driving the valve spool 214 that is actuated by the drive source, the valve spool 214 is accelerated more quickly. In the constant-speed region k-1, the valve spool 214 moves at a constant speed, and the driving force needs be very small. Therefore, even if the thrust is decreased as denoted by d-e-f, operation of the valve spool 214 is affected very little. In the deceleration region 1-m, the thrust for deceleration must be acted upon the valve spool 214 which had been moving at a constant speed over the region k-1 in order to bring it into halt. The deceleration thrust is generated by the drive source. In the deceleration region 1-m, it is necessary to cancel as much as possible the thrust in the opening direction that is produced by the fluid that is to be controlled. In this embodiment, the axial thrust IV changes as denoted by f-g over the deceleration region 1-m, and its values lie over a range of $\frac{1}{4}$ to $\frac{1}{3}$ compared with the values of b-c-d. The reason why such values are employed is because the resistance by friction helps increase the deceleration force in the deceleration region, and sufficient braking performance is obtained even if the axial thrust is generated to such a degree. Moreover, the braking function makes it possible to bring the back-lash of the screw portion of the ball-screw mechanism in the drive system into zero apparently. Depending upon the conditions, furthermore, negative thrust characteristics f'-g' may be imparted in the axial direction as represented by a broken curve IV'. Further, not limited to the pattern shown in FIG. 16, the moving characteristics of the valve spool 214 may be selected as represented by patterns B to E in FIG. 19 to meet the output characteristics of the drive source or the thrust characteristics in the axial direction.

To obtain axial thrust characteristics IV, IV' of FIGS. 17 and 18, i.e., to obtain axial thrust characteristics that abruptly decrease with the increase in the opening amount of the valve spool and that describe convex curves downwardly, values of the following requirements (a) to (e) should be suitably selected:

(a) Velocity of flow $v_1$ of the fluid flowing into the flow adjusting valve:

Forces $F_1$ and $F_2$ increase with the increase in $v_1$. The force $F_0$, however, is not affected.

(b) Sectional area $a_2$ of the valve spool:

Forces $F_1$ and $F_2$ increase with the increase in $a_2$. The force $F_0$, however, is not affected.

(c) Sectional area $a_1$ of the drive rod:

The force $F_0$ increases with the increase in $a_1$.

(d) Sum $b_1$ of opening areas of communication holes 15:

The force $F_2$ increases and the $F_1$ decreases with the increase in $b_1$.

(e) Distance $b_2$ between the comunication hole 15 and the axis of the value spool:

The force $F_2$ decreases with the increase in $b_2$.

According to the control method described above, the axial thrust of the valve spool produced by the fluid to be controlled is abruptly reduced with the increase in the opening amount of the valve spool. Therefore, the valve spool can be moved at high speeds requiring a greatly reduced driving force.

Figure 20:
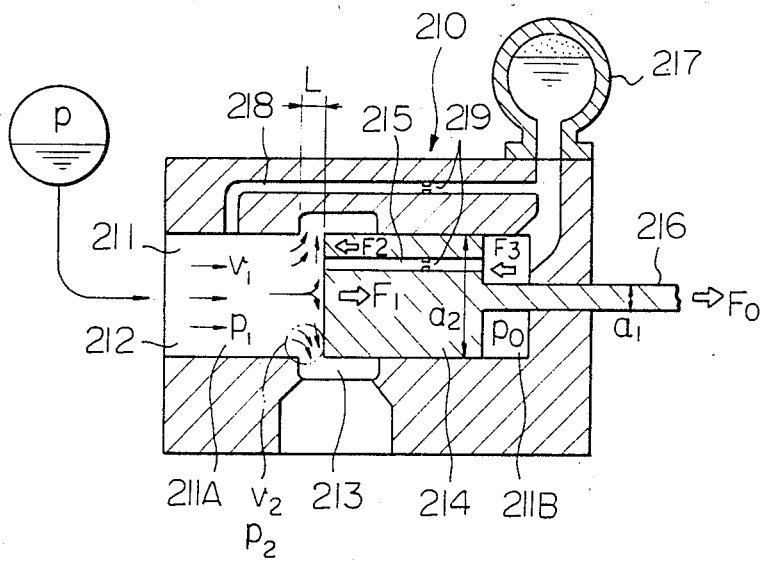
FIG. 20 is an axial sectional view of major portions of another embodiment of a flow adjusting valve according to the present invention.
Figure 21:
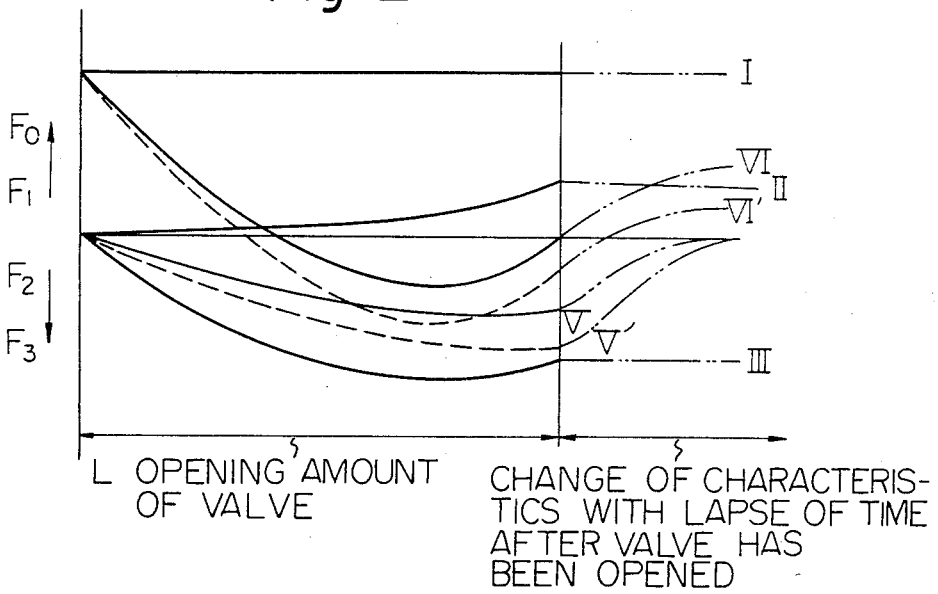
FIG. 21 is a diagram of the relations among the axial thrust of the valve spool, opening amount of the valve spool, and change of characteristics with the lapse of time, established by the fluid in the valve as shown in FIG. 20.

FIG. 20 schematically illustrates major portions ccnstituting the second flow adjusting valve.

In FIG. 20, the same reference numerals as those of FIG. 14 denote the same elements. In FIG. 20, however, an accumulator 217 is communicated with the chamber 211B on the side opposite to the inlet port 212, and throttle portions 219 are formed in the through holes 215 and 218 through which the chamber 211B is communicated with the chamber 211A. The throttle portions 219 may be formed in a fixed manner, or either one of them may be movably constructed. Or the throttle portion 219 may be installed in either one of the through hole 215 or the through hole 218. The accumulator 217 diagrammed here stores a gas or a liquid. The accumulator, however, may be the one which utilizes a mechanical spring.

With reference to FIG. 20, when the valve spool 214 moves rightwards from the region of small flow rate toward the region of large flow rate, the fluid to be controlled in the chamber 211B flows into the chamber 211A through the throttle portions 219. Here, however, the fluid flows into the chamber 211A in a limited amount due to the throttle function of the throttle portions 219. Therefore, the fluid to be controlled in the chamber 211B flows into the accumulator 217 by an amount that is limited by the throttle portion 219, whereby the gas in the accumulator 217 is compressed. The pressure $p_0$ in the chamber 211B changes depending upon the amount of compression, and the force $F_3[F_3=(a_2-a_1)\times(p_0 p_1)]$ is generated in the same direction as the force $F_2$, to increase the braking action for the valve spool 214. The force $F_3$ increases with the increase in the moving speed and moving amount of the valve spool 214. Characteristics of the braking force $F_3$ match well the characteristics necessary for braking the valve spool 214, and braking ability of the valve spool 214 is greatly increased. If movement of the valve spool 214 stops, the force $F_3$ reduces to zero after a given period of time has passed. Characteristics of other forces $F_0$, $F_1$ and $F_2$ are the same as the characteristics of the case of the first invention. Therefore, thrust characteristics VI (VI=I+II+III+V), VI'(VI'=I+II+III+V') in the axial direction in the second invention are as diagrammed in FIG. 21, in which a curve V represents the change of force $F_3$ when the opening speed of the valve spool 214 is small, and a curve V' represents the change of force $F_3$ when the opening speed of the valve spool 214 is large. In FIG. 8, the portions of two-dot chain lines represent change in the characteristic with the lapse of time after the valve spool 14 has been opened to desired positions.

Accordingly to this control method, the axial thrust of the valve spool generated by the fluid to be controlled decreases rapidly with the increase in the opening amount of the valve spool 214 and, further, the axial thrust decreases with the increase in the moving speed of the valve spool 214. Therefore, the flow adjusting valve exhibits high-speed performance for switching the flow rate, while requiring reduced driving force.

I claim:

1. A spool-type flow adjusting valve comprising:

a valve body having a flow inlet and a flow outlet for transferring a pressurized fluid within said valve;

A valve bore formed within said valve body to communicate with said flow inlet and said flow outlet and having a first and a second chamber at opposite ends of said valve bore, said flow inlet being connected to said first chamber;

a valve spool slidably positioned within said valve bore and maintaining frictional engagement therewith, said valve spool having a cylindrical rod for slidably positioning said valve spool along the axis of said rod between said first and said second chambers, the surface area of said valve spool facing said first chamber being greater than the surface area of said valve spool facing said second chamber, the opening and closing of said flow outlet being dependent upon the reciprocating movement of said valve spool within said valve bore;

means for slidably positioning said cylindrical rod; and at least one flow passage formed within said valve spool for interconnecting said first and second chambers, said flow passage being defined by a through-hole formed along the length of said valve spool, wherein the flow of the fluid passing between said flow inlet and said flow outlet increases as said valve spool moves in the direction of said second chamber and opens said flow outlet; and a groove between the outer surface of said valve spool adjacent said valve bore and said flow passage for allowing the fluid to flow from said flow passage and into said flow outlet when said groove is aligned with said flow outlet, and wherein said flow outlet includes first and second channels extending substantially perpendicular to the axis of said valve spool, said first channel being in fluid communication with said first chamber and said second channel for fluid communication with said flow outlet when said groove is aligned with said second channel, each of said first and second channels having a circumferential cut-out section along said valve bore for communicating said fluid from said first chamber to said first and second channels when said cut-out sections are uncovered by movement of said valve spool, and wherein the difference between the surface area of said valve spool facing said first chamber and the surface area of said valve spool facing said second chamber produces a pressure differential at the opposing surfaces of said valve spool for generating thrust forces for positioning said valve spool within said valve bore.

2. The spool-type flow adjusting valve as defined in claim 1, wherein said means for slidably positioning said cylindrical rod includes:

a housing mounted adjacent said second chamber of said valve bore, the adjacent surfaces of second chamber and said housing having shaft receiving means coaxially aligned with said cylindrical rod;

a connecting shaft slidably supported within said shaft receiving means and having a rod portion and a cylindrical portion, said rod portion being connected to said valve spool;

motor means having a driving member and a driven member mounted within said housing for imparting rotational movement within said housing; and conversion means connecting said cylindrical portion of the connecting shaft to said driven member for transforming rotational movement into reciprocating movement, said conversion means including a nut attached to said cylindrical portion, a drive shaft connected to said driven member for rotation within said nut, and means for preventing said nut from rotating relative to said housing.

3. The spool-type flow adjusting valve as defined in claim 2, wherein balls are rotatably positioned between said nut and said screw drive shaft, and wherein said motor means includes a pulse motor.

4. The spool-type flow adjusting valve as defined in claim 3, wherein said rotation prevention means includes a means projecting from said nut and a slot formed by said housing and extending a predetermined distance substantially parallel to the axis of said drive shaft, said projection being slidable within said slot.

5. The spool-type flow adjusting valve as defined in claim 4, wherein said cylinder portion includes a plurality of perforations disposed in spaced and angled intervals about the circumference of said cylinder portion.

6. The spool-type flow adjusting valve as defined in claim 4, wherein said conversion means includes a sensor having a magnetic element affixed to said nut, and switch means attached to said housing for detecting the position of said magnetic element, said switch means providing feedback to said motor for controlling the axially sliding movement of said valve spool.

7. The spool-type flow adjusting valve as defined in claim 4, wherein said flow passage is proximate the periphery of said valve spool.

* * * * *